US006748863B2

(12) United States Patent
Miller

(10) Patent No.: US 6,748,863 B2
(45) Date of Patent: Jun. 15, 2004

(54) METHOD AND APPARATUS FOR TRANSFERRING PRINTED SHEETS

(76) Inventor: Mark Miller, 305 Via Altos, Mesquite, TX (US) 75150

( * ) Notice: Subject to any disclaimer, the term of this patent is extended or adjusted under 35 U.S.C. 154(b) by 0 days.

(21) Appl. No.: 10/167,168

(22) Filed: Jun. 11, 2002

(65) Prior Publication Data

US 2003/0226461 A1 Dec. 11, 2003

(51) Int. Cl.[7] ..... B41F 21/00

(52) U.S. Cl. ..... 101/415.1; 101/232; 492/42; 492/45

(58) Field of Search ..... 101/415.1, 232; 492/42, 45

(56) References Cited

U.S. PATENT DOCUMENTS

| | | | | |
|---|---|---|---|---|
| 3,237,558 A | * | 3/1966 | Fagg, Jr. | 101/415.1 |
| 3,602,140 A | | 8/1971 | Sudduth | |
| 3,791,644 A | | 2/1974 | DeMoore | |
| 4,402,267 A | | 9/1983 | DeMoore | |
| 4,625,376 A | * | 12/1986 | Schiel et al. | 492/26 |
| 4,691,632 A | * | 9/1987 | DeMoore | 101/483 |
| 4,694,750 A | * | 9/1987 | Greene | 101/483 |
| 5,042,384 A | * | 8/1991 | DeMoore et al. | 101/483 |
| 5,603,264 A | | 2/1997 | DeMoore et al. | |
| 6,073,556 A | | 6/2000 | DeMoore et al. | |
| 6,192,800 B1 | | 2/2001 | DeMoore et al. | |

OTHER PUBLICATIONS

No–Mark Full Cylinder Anti–Tracking.

* cited by examiner

*Primary Examiner*—Andrew H. Hirshfeld
*Assistant Examiner*—Jill E Culler
(74) *Attorney, Agent, or Firm*—Yellow Jacket Industries; Mark Miller

(57) ABSTRACT

A rotary printing press transfer cylinder has two or more axially spaced apart discs of a given diameter, each disc having an open minor segment with inwardly disposed edges and a concentric, shaft receiving hub to support the discs for rotation. A flexible plastic sheet, with flanges bent to fit within the inwardly disposed edges, covers the discs to provide a cylindrical shape, and is held under tension by attaching members connected to the flanges. A cushioning, ink repellent jacket is attached over the flexible plastic sheet.

21 Claims, 6 Drawing Sheets

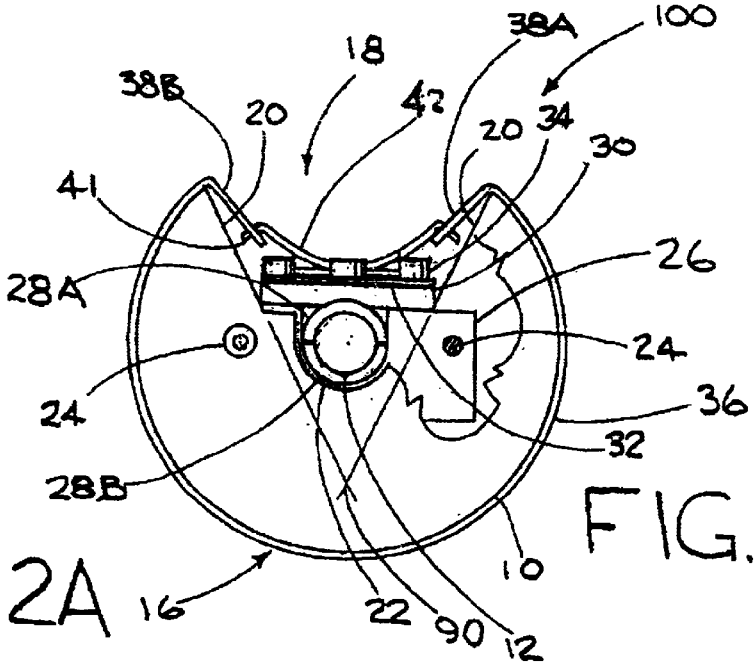
FIG. 2
FIG. 2A
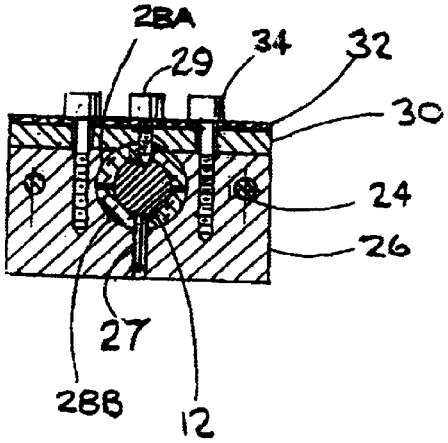
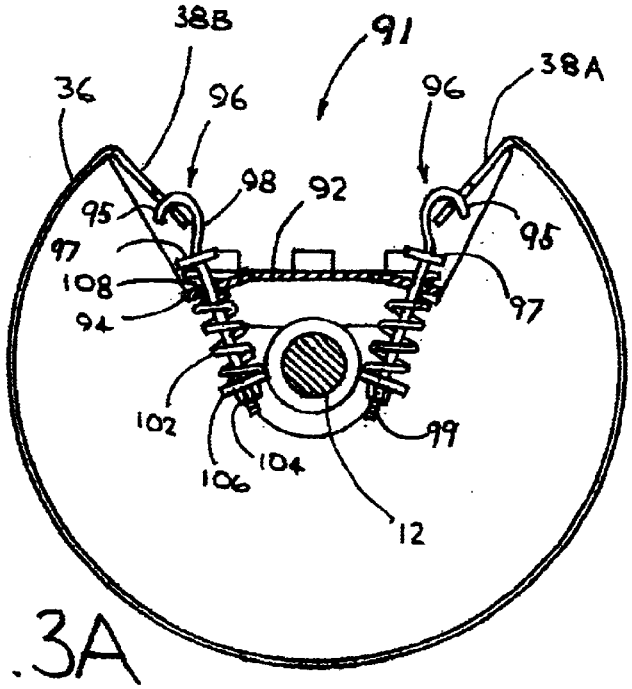
FIG. 3A

METHOD AND APPARATUS FOR TRANSFERRING PRINTED SHEETS

TECHNICAL FIELD

The present invention relates to the field of sheet handling cylinders for printing presses and more particularly, to such cylinders as are used to transfer sheets between printing stations or to deliver freshly printed sheets for stacking.

BACKGROUND

In rotary offset printing, freshly printed sheets are transported from one printing station to the next and finally, delivered to a sheet stacker. The transport and delivery steps are accomplished by sheet transfer devices, usually in the form of special purpose cylinders, which include an arcuate gap to accommodate the paper feed grippers. The freshly printed sheets are subject to ink tracking and marking if not handled with great care. Traditionally, this problem is mitigated by minimizing contact pressure and/or active contact area with the transfer cylinders. Sheet support wheels in the form of thin disks with serrated edges, to minimize contact area, are frequently provided as "skeleton wheels". Even so, ink tracking and marking continue to be a persistent problem. An opposite approach to minimizing the contact area by using multiple skeleton wheels is the use of a full width, low friction cylinder for reduced contact pressure and sheet drag. This has proven to be more effective for the intended purpose, particularly when the cylinder is covered with a soft fabric jacket to provide a cushioning effect.

U.S. Pat. No. 4,402,267 discloses the use of low friction coating on the surface of a transfer cylinder, over which a covering or jacket of flexible material is loosely fitted. It is disclosed that the low friction coating of the transfer cylinder permits relative movement to take place between the jacket and cylinder surface, and that this freedom of relative movement contributes significantly to tracking/marking prevention.

U.S. Pat. No. 6,073,556 discloses that relative movement between the jacket and cylinder surface is impeded by the build-up of a static electric charge. The low friction transfer cylinder coating of the prior art acts as an insulator, so that friction induced static electricity from the printed sheets accumulates on the surface of the transfer cylinder. As a consequence of this electrostatic charge transfer and accumulation, the flexible jacket covering tends to cling to the underlying cylinder surface and lose its freedom of movement. 6,073,556 teaches the inclusion of a conductive agent such as carbon black, or the like, in the low friction coating of the transfer cylinder for dissipation of the above referenced static charge. Thus, relative movement between the jacket and cylinder surface is unimpaired.

A commercially available system sold under the "NO-MARK" name employs a semi-rigid plastic sheet blanket having a proprietary, micro-beaded silicone surface and a full surface backing of loop VELCRO. "Skeleton wheels", in the form of thin, segmented discs, with peripherally applied strips of hook VELCRO, are spaced along a transfer cylinder shaft. The blanket is wrapped around the skeleton wheels and held in place by the connection of VELCRO loops and hooks. Additional support is provided to the blanket by a series of longitudinal support members, set flush with the skeleton wheel edges. An ink repellent jacket is not required for this system.

Conventional rotary printing cylinders are machined from somewhat complex aluminum castings. The basic cost of the cast and precision machined cylinder, plus the cost of the conductive, low friction coating and the jacket is significant so that a typical, non-marking cylinder assembly will sell for upwards of $800.00. This is partially because variations in width, shaft size and cylinder diameter are such that virtually every cylinder is a custom design for a specific printing press make and model, mandating small volume production runs and high costs at the factory. This also creates inventory and availability problems for replacement parts at the dealers and repair shops.

Therefore, a first object of the present inventions is to provide more economical, non marking transfer cylinder apparatus, in a form that lends itself to the use of relatively inexpensive and readily available materials. A second object of the present inventions is to provide transfer cylinders in standardized configurations, so that only a few sizes can be retrofitted to a broad range of printing machines. A third object of the present inventions is to provide serviceable, non-marking transfer cylinders, that require little maintenance and are capable of surviving paper jams and abuse without sustaining permanent damage. A fourth object is to provide non-marking transfer cylinders that are easy to assemble and install. A fifth object is to provide a cylindrical jacket with strong tension.

SUMMARY OF THE INVENTION

The present inventions contemplate apparatus for improved non-marking transfer cylinders as used on rotary printing presses. These inventions relate to or employ some steps and apparatus well known in the rotary printing press arts, and thus not the subject of detailed discussion herein.

Rotary printing press transfer cylinders of the present inventions have one or more axially spaced apart discs, with a radiused major segment and an open minor segment having inwardly disposed edges that join into a central opening. Each disc has a shaft receiving hub at the central opening, mounted concentric with the major segment diameter and sized to receive a central, rotating shaft. A flexible, plastic sheet or thin metal covers the major disc segments, so as to provide a cylindrical shape, and this sheet has axially oriented flanges, bent inwardly to fit within the inwardly disposed minor segment edges. Attaching members, preferably including a flexible central portion, hook into holes in the cover sheet flange, to pull the sheet closely against the outside diameter of the major segments. The attaching members are tensioned and held in place with respect to the spaced apart discs by a removable mounting member or by attachment to the central shaft. An ink repellent jacket, attached over the cover sheet, provides cushioned, non-marking contact with printed sheets for transfer in a manner well known to those skilled in the printing arts. While many variations in the manner of attachment of the cover sheet flanges to the discs and the jacket to the cover sheet are possible, only preferred apparatus and methods are disclosed.

The cover sheet may be jacketed with any available anti-making material. A preferred method is an ink repellent, cushioning blanket of fabric or webbing such as is commercially available from PRINTING RESEARCH, INC., in Dallas, Tex. or from BBA NONWOVENS in Simpsonville, S.C. There are some in the art who espouse loose attachment of the blanket to the cylinder, so as to permit relatively free movement of the blanket with respect to the cylinder surface for better non-marking performance. However, it has been determined that, at least in the case of the present inventions, such freedom is not necessary to non-marking performance.

Thus, such blankets can be held in place around the cover sheet of the present inventions in a variety of ways, including the use of VELCRO, double-sided tape, a spray-on adhesive or mechanical fasteners. In the preferred embodiment, adhesive backed VELCRO strips applied to the cover sheet flanges and inside of the extended ends of the cover sheet provide hooks that engage the mesh of the jacket material so as to hold it in place. As an alternative, that portion of the blanket which extends beyond the cylinder ends may be secured by spring clips inserted within the extended cylinder ends so as to bear against the folded-under blanket edges. Another option is the use of double-sided adhesive strips applied to hold the folded-under blanket edge in place.

Yet another aspect of the present inventions is the clearance dimension between the transfer cylinder and the impression cylinder from which printed sheets are taken. It has been determined empirically that, at least for the present inventions, as the weight of the printed paper stock increases, so does the best clearance for non-marking. The preferred clearance is found to be in the range of 0.38" for 20 lb. paper and increases up to 0.75" for 100 lb. cover stock. The "0.25" industry standard" clearance dimension is workable for 20 lb. paper stock, but notably less effective for the intended purpose of non-marking when transferring heavier stocks.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which:

FIG. 2 is an end view of FIG. 1, showing details of the assembly;

FIG. 2A is a section view taken through the hub plate of FIG. 2.

FIGS. 3A, 3B, 3C and 3D are section views such as might be taken along plane 3—3 of FIG. 1, showing alternative cover sheet attachments;

DETAILED DESCRIPTION OF THE DRAWINGS

Figure 1:
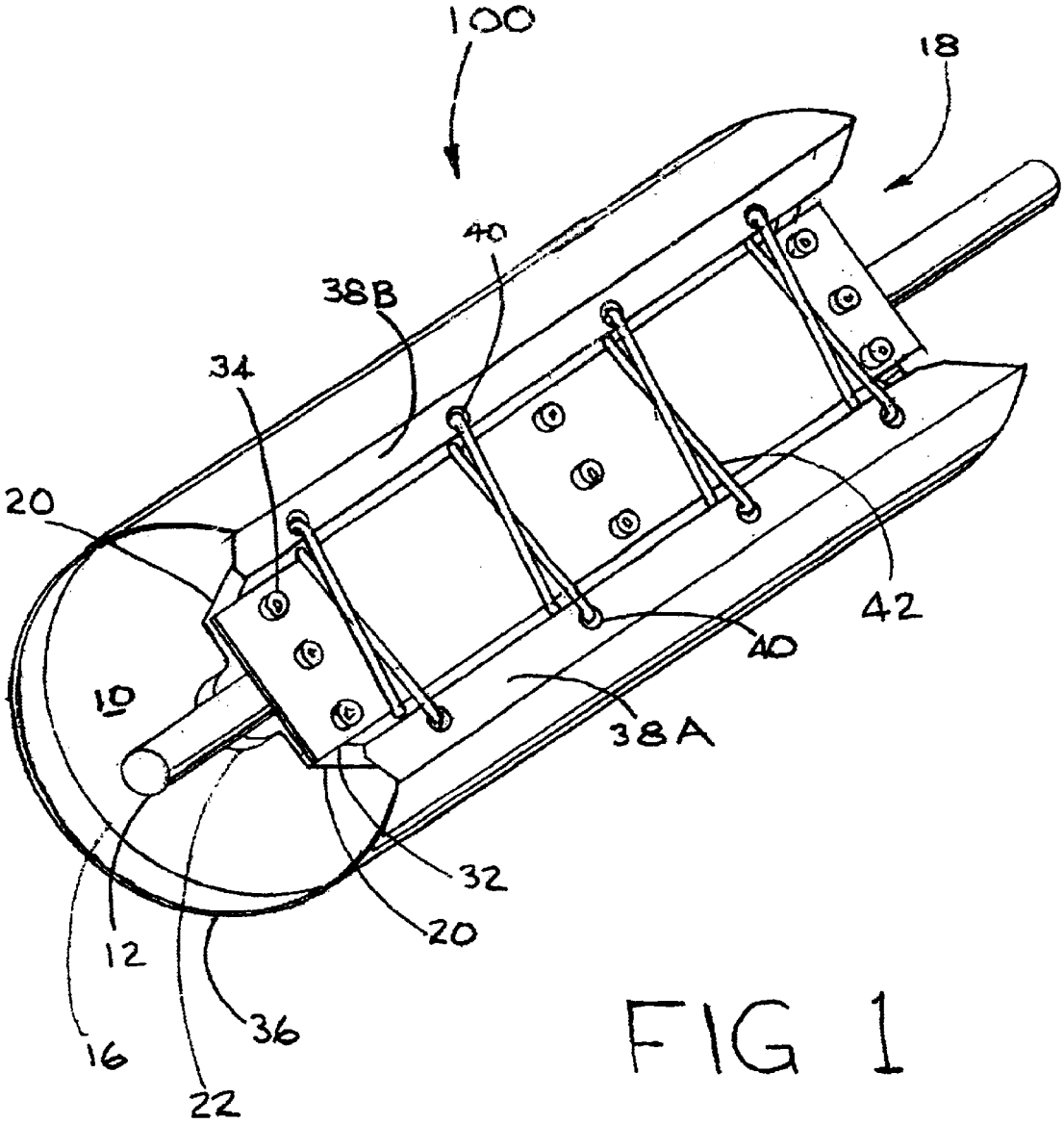
FIG. 1 is a perspective view of a preferred embodiment of the non-marking transfer cylinder of the present inventions.

The present inventions are described in the following by referring to drawings of examples of how the inventions can be made and used. In these drawings, reference characters are used throughout the views to indicate like or corresponding parts. The embodiments shown and described herein are exemplary. Many details, that are well known in the art, are neither shown nor described.

FIGS. 1 and 2 are views of a preferred embodiment of the non-marking transfer cylinder of the present inventions. FIG. 1 shows segmented discs 10 axially spaced apart on central shaft 12 and in FIG. 2, segmented discs 10 are seen to comprise radiused major segment 16 and open minor segment 18. The radii of major segments 16 define the location of the axes of transfer cylinder 100 and central shaft 12. Minor segment 18 is delineated by symmetrical, inwardly disposed edges 20, which join into the central opening 22. In rotary printer operation, open minor segment 18 provides the clearance dimension needed for movement of the impression roll sheet grippers as they lift the printed sheet for transition to transfer cylinder 100. In order to provide adequate gripper clearance, the included angle between inwardly disposed edges 20 has its apex 90 at a point beyond the axis of central shaft 12.

Hub plates 26 are mounted on the inside surfaces of segmented discs 10 by means of bolts 24, so as to locate split bushing halves 28A and 28B in alignment with the axis of transfer cylinder 100. Mounting plate 32, located in open minor segments 18, extends across the width of spaced apart, segmented discs 10. Bushing caps 30 hold bushing halves 28A and 28B together and are clamped down under mounting plate 32 by bolts 34. Hub plates 26, bushing caps 30 and bushing halves 28 A & B may be furnished to fit any shaft diameter within a nominal range, giving transfer cylinder 100 adaptability to fit different printer makes and models.

Disc cover sheet 36 curves tightly around the diameter of major segment 16, with inwardly bent flanges 38A and 38B extending into open segment 18. Both flanges 38A and 38B include a like plurality of uniform attaching holes 40. A first end hook 41 of attaching member 42 engages each attaching hole 40, so that disc cover sheet 36 is pulled tightly around cylinder 100. In this preferred embodiment, attaching members 42 are held in place by mounting plate 32, so as to apply tensile force at attaching holes 40. Disc cover sheet 36 may be made of plastic in a preferred embodiment for general use, or if transfer cylinder 100 is to be exposed to high temperatures, as in a heat setting process, it may be made of thin stainless steel sheet.

Disc cover sheet 36 provides another aspect to the printer make and model flexibility of the present inventions. Adaptation of a standardized cylinder width for installation in a smaller printer may be achieved by simply trimming the width of cover sheet 36.

FIG. 2A is a section view taken through hub plate 26 and half bushings 28 of FIG. 2. Here is shown that bushing half 28A is pinned in location by roll-pin 27 and that, in a similar manner, bushing half 28B is held in place by locking bolt 29. Further, it is shown that locking bolt 29 is screwed through bushing cap 30 and extends through bushing half 28B to bear against central shaft 12 and hold assembly 100 in axial location on central shaft 12. The outside diameter of half bushings 28A&B is made purposely large, so that a wide range of inside diameters can be made available to accommodate different make and model rotary printing machines.

Figure 3B:
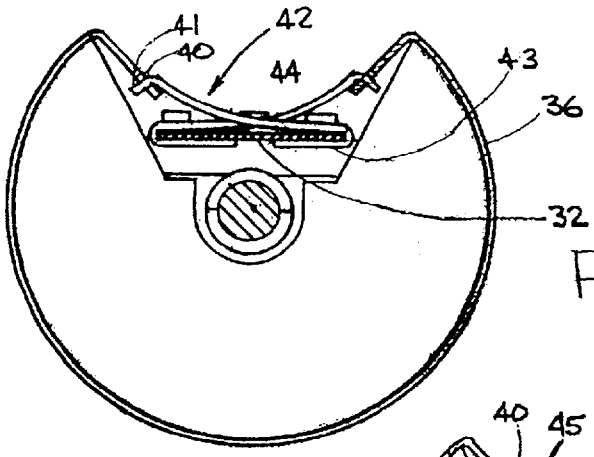

FIG. 3B. shows a detail view of the attaching member 42 of FIGS. 1 and 2, where it is shown that, in addition to first end hook 41, attaching member 42 also includes a flexing central portion 44 and second end 43. As shown here and in FIG. 2, hook end 41 is configured to engage an attaching hole 40 and second end 43 fits about the edge of mounting plate 32, so as to hold attaching member 42 in place. Fixed in this manner, flexing of central portion 44 applies a holding force to cover sheet 36.

FIG. 3A shows a detail view of preferred embodiment 91 of attaching spring apparatus 96. Here, mounting plate 92 is seen to be a modified form of previously disclosed mounting plate 32. Tabs 94, with holes 108, are bent at an offset angle to place attaching spring apparatus 96 in alignment with cover sheet flanges 38A and 38B. Hook members 98 comprising hook ends 95, collars 97 and shank ends 99 are shown to have hook ends 95 inserted into attaching holes 40. Shank ends 99 pass through holes 108 and coil springs 102, where flat washers 106 and nuts 104 hold coil springs 102 in compression against collars 97. Thus, a tensile force is applied to flanges 38A and 38B, holding cover sheet 36 in place.

Figure 3C:
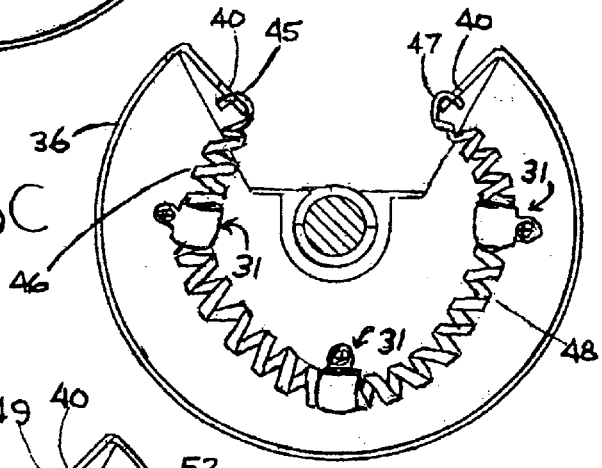

FIG. 3C shows a preferred alternative embodiment in the form of attaching member 46. First end hook 45 and second end hook 47 are similar and flexing central portion 48 is a coiled spring. As shown here, end hooks 45 and 47 engage opposite attaching holes 40 and clamps 31 holds attaching member 46 in place, so that flexing of central portion 48 applies a tensile force to hold cover sheet 36 tightly in place. In this case there is no additional requirement for retention of a coil spring 48, so that no equivalent of mounting plate 32 is shown.

Figure 3D:
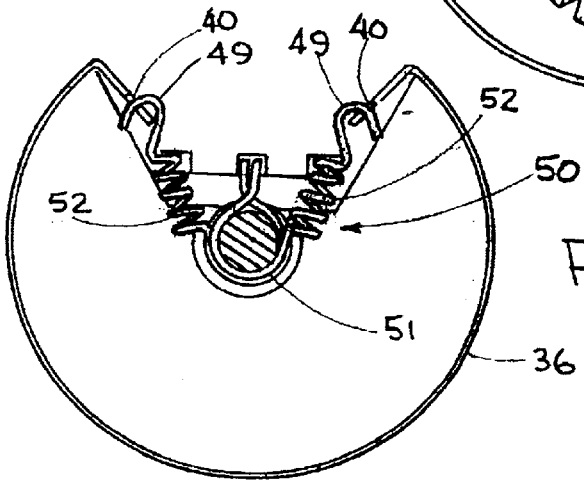

FIG. 3D shows a second preferred alternative embodiment in the form of attaching member 50. First end hook 49 engages attaching hole 40 and second end hook 51 is configured to engage central shaft 12, while flexing central portion 52 is a coiled spring. As shown here, the engagement of opposed end hooks 49 and 51 exert a tensile force at attaching holes 40, so as to hold cover sheet 36 tightly in place. In this case, there is no additional requirement for retention of attaching member 50, so no equivalent of mounting plate 32 is shown.

Figure 4A:
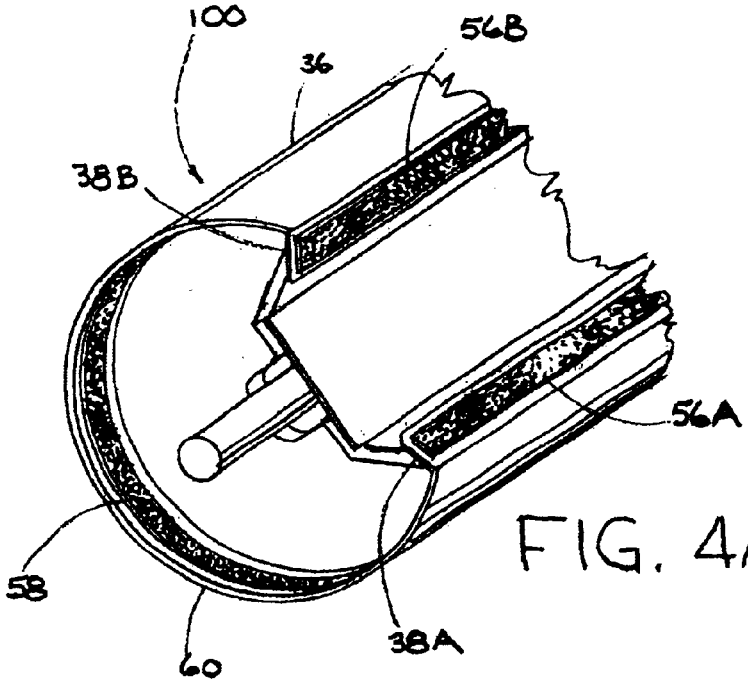
FIGS. 4A, 4B, and 4C are partial perspective views, showing alternative blanket retention devices.

FIG. 4A shows cylinder 100 as it appears when prepared for fitting a blanket of gauze-like fabric over cover sheet 36. VELCRO strips 56A and 56B, with adhesive backing and a multiplicity of closely spaced hooks, are applied to inwardly bent flanges 38A and 38B. The hooks of Type 24 VELCRO have been found to engage the fabric threads of typical blanket materials in much the same manner as VELCRO loops. Similar VELCRO strips 58 are applied inside of the extended ends 60 of cover sheet 36. When the edges of a gauze-like blanket are pressed firmly against VELCRO strips 56 and 58, the material will be enmeshed in the hooks of VELCRO strips 56 and 58, holding the blanket tightly or loosely in place, as applied by the printer.

Figure 4B:
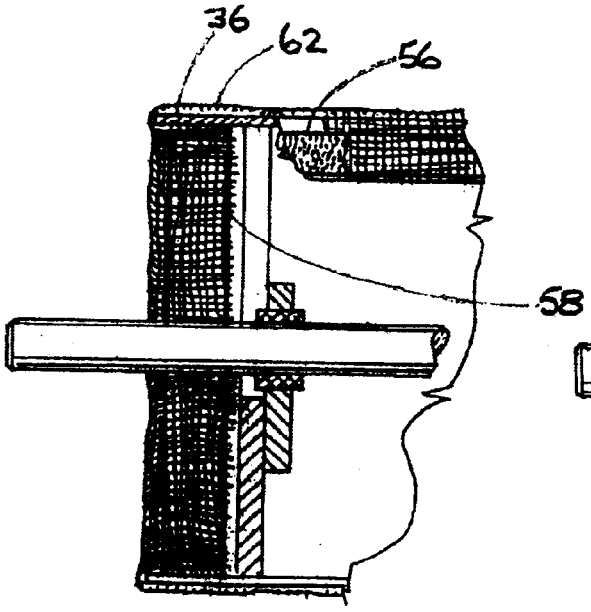

FIG. 4B shows cushioning blanket 62 of ink repellent fabric or webbing, trimmed to fit over cover sheet 36, with the blanket edges pressed firmly against VELCRO strips 56 and 58. The material of blanket 62 is enmeshed in the hooks of VELCRO strips 56 and 58, again holding blanket 62 tightly or loosely in place, as the printer desires. This same method of attaching blanket 62 to cover sheet 36 may also be accomplished by the use of double-sided adhesive strips.

Figure 4C:
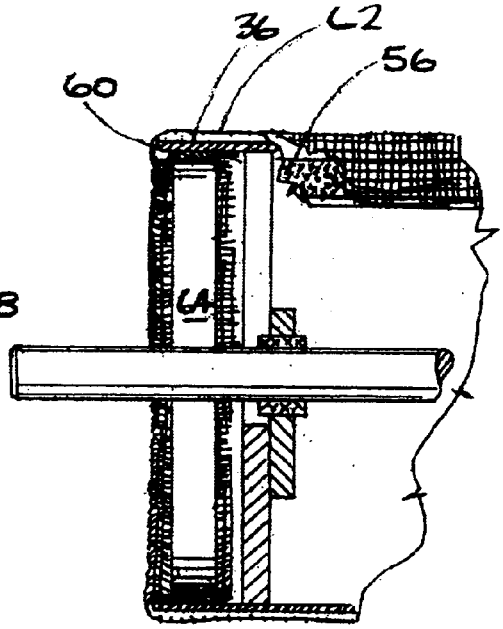

FIG. 4C illustrates an alternative method for holding the edges of blanket 62 in place at the extended ends 60 of cover sheet 36. Here, expanding circular spring member 64 is compressed to fit inside of extended end 60 and released, so as to clamp the edges of blanket 62 against the inside surface of cover sheet 36. This action, together with VELCRO (or double sided adhesive) strips 56 and 56 serves to hold blanket 62 securely in place.

Figure 5:
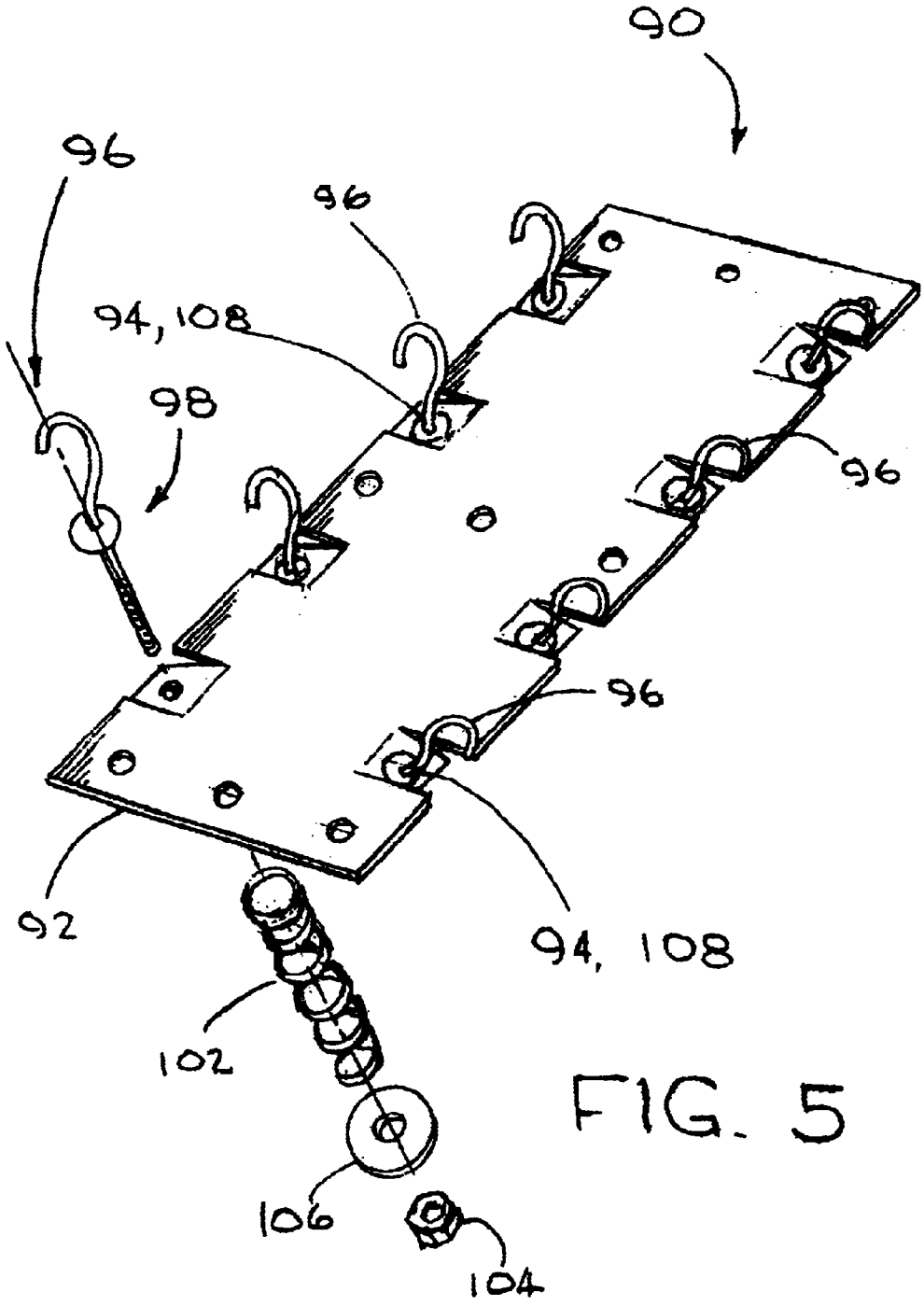
FIG. 5 shows a preferred mounting plate and cover attachment spring apparatus assembly applicable to FIG. 3D.

FIG. 5 shows an exploded perspective view of preferred embodiment 91 of attaching spring apparatus 96. Here, mounting plate 92 is shown with tabs 94 and holes 108 bent at an offset angle to place attaching spring apparatus 96 in alignment with cover sheet flanges 38A and 38B, as discussed above. Hook members 98, comprising hook ends 95, collars 97 and shank ends 99, are shown to have hook ends 95 inserted into attaching holes 40. Shank ends 99 pass through holes 108 and coil springs 102, where flat washers 106 and nuts 104 hold coil springs 102 in compression against collars 97. Thus, hook members 98 can be pulled out, and at an angle, as necessary to hook into holes 40 for holding cover sheet 36 in place.

Figure 6:
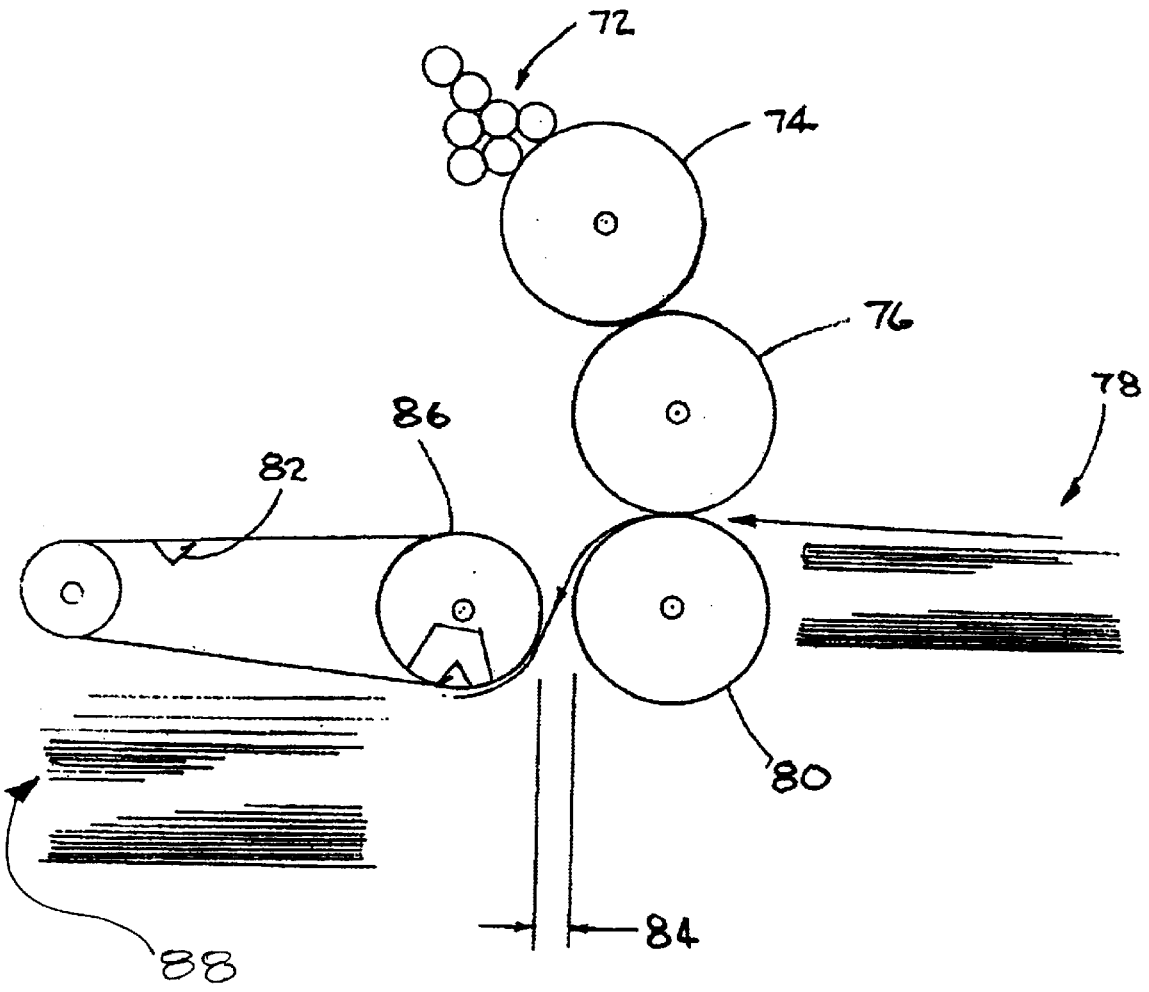
FIG. 6 shows the preferred dimensional relationship between a transfer cylinder and an impression cylinder.

FIG. 6 shows a schematic view of typical rotary printing press 70 and the several rollers and cylinders involved in the rotary printing process. Ink rollers 72 distribute ink to plate cylinder 74, which inks the reversed printing image on rubber blanket cylinder 76. Paper sheets 78 are fed to pass between rubber blanket cylinder 76 and impression cylinder 80 for printing and are taken from impression cylinder 80 by grippers 82. Here is illustrated another beneficial non-marking measure, not known to those of ordinary skill in the printing arts, involving the clearance dimension 84 between the impression cylinder 80 and transfer cylinder 86 of typical rotary printing press 70. Customary practice would have this dimension to be in the 0.25" to 0.38" range. At least for the present inventions it has been determined empirically that, as the weight of the printed paper increases, so does the best clearance dimension for non-marking. Thus, the preferred clearance dimension 84 is found to be in the range of 0.38" for 20 lb. paper and it increases up to approximately 0.75" for 100 lb. cover stock. The "0.25" industry standard" clearance dimension is workable with 20 lb. paper, but at least in the case of the present inventions, is notably less effective for the intended purpose of non-marking with heavier stocks. It is considered that the added clearance allows softer contact during the reverse bend of printed sheet 78 on transfer cylinder 86 as it is guided to delivery stack 88. Since there is little, if any, performance penalty for clearance dimensions in excess of the preferred 0.38", 20 lb. paper can readily run at the 0.75" clearance dimension 84 preferred for heavier cover stock. The fact that an increased clearance dimension 84 enhances overall non-marking performance, and that this dimension can be varied over a greater range than those skilled in the printing arts have heretofore realized, has the salutory benefit of allowing a given diameter transfer cylinder 86 to be used on a broader range of printer makes and models. The following table of popular rotary printing press transfer cylinder and shaft diameters represents the requirements of perhaps 95% of the replacement non-marking cylinder market. It is notable that, with the present inventions, this entire range of makes and models can be served with only 3.63" and 5.5" diameter cylinder assembly kits.

| Press Description | Manufactured Wheel and Shaft Diameters | Approximate Clearance with 3.63" Diameter Cylinder |
|---|---|---|
| A. B. Dick 360, 375 & 9800 Old Series | 4.3" × ¾" | ½" |
| A. B. Dick 376, 380, 385 | 4.3" × ¾" | ½" |
| Hamada 700 Series | 4.0" × ⅝" | ⅜" |
| Multilith AM 1217, Old Press Specialty Chain | 4.0" × ⅝" | ⅜" |
| AM Multi 1218, 1218EI (2 Grippers) | 4.5" × 16 mm | ½" |
| AM Multi 1218, 1218EI (3 Grippers) | 4.5" × 20 mm | ½" |
| Toko 4700, Embassy, Imperial (2 Grippers) | 4.5" × 16 mm | ½" |
| Toko 4700, Embassy, Imperial (3 Grippers) | 4.5" × 20 mm | ½" |
| Ryobi & ITEK 2800 CD Series | 4.3" × 20 mm | ½" |
| Ryobi 480/500N Series Mid-Size Press | 4.0" × ⅞" | ¼" |

Approximate

-continued

| Press Description | Manufactured Wheel and Shaft Diameters | Clearance with 5.5" Diameter Cylinder |
|---|---|---|
| A. B. Dick 8900/9800 Enhanced 1:1 Series | 6.3" × ⅝" | .63" |
| A. B. Dick 9880/9890 Enhanced 1:1 (Landscape) | 6.3" × ⅝" | .63" |
| ATF Chief 15, Chief 17 Duplicators | 6.3" × ⅝" | .63" |
| Hamada 800 Series (20 mm = approx. ¾") | 5.8" × 20 mm | .25" |
| Hamada 500/600 Series (16 mm = approx. ⅝") | 5.8" × 16 mm | .25" |
| ITEK 960 New Series & AR 975 Series | 6.5" × 20 mm | .63" |
| ITEK 3985 Series, 2-Color w/Multi-bar Delivery | 6.5" × ⅞" | .69" |
| Multilith AM 1250, 1360, 1650 | 6.0" × ¾" | .31" |
| Multilith 1850 | 6.0" × ¾" | .31" |
| Ryobi 2800 & All 3200 DX Series | 6.5" × 20 mm | .63" |
| Ryobi 3302 Series w/Multi-bar Delivery | 6.0" × ⅞" | .69" |

The aforementioned shaft size adaptability together with the cylinder diameter range discussed above, serve to give a cylinder assembly of the present inventions broad application to printers of various makes and models. These factors have even greater impact when it is considered that plastic cover sheet 36 may be trimmed to shorten the cylinder for a narrower printing press. Thus, make and model flexibility for transfer cylinders according to the present inventions is achieved by the broader application of a few basic cylinder diameters. In this manner, a few standardized kits can be adapted for installation on virtually any rotary printer.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but provide at least one explanation of how to use and make the inventions. The limits of the inventions and the bounds of the patent protection are measured by and defined in the following claims.

I claim:

1. Apparatus for a rotary printing press transfer cylinder comprising:

At least two axially spaced apart discs having a closed major segment and an open minor segment with inwardly disposed edges joining into a central opening;

shaft receiving hubs mounted to the at least two discs, at the central opening and concentric with the major segments;

a central shaft fitted through the shaft receiving hubs;

a flexible, disc cover sheet having a length and width to cover the major segment diameters, with first and second flange portions bent to fit within the open minor segment, each flange portion including a plurality of attaching holes for attachment of the disc cover sheet to the spaced apart discs;

a plurality of attaching spring apparatus having ends configured to engage the attaching holes of the first and second flange portions and spring portions to pull the cover sheet against the major segment diameters;

an axially oriented mounting plate affixed to the at least two discs and holding tension on the attaching spring apparatus.

a cushioning blanket fitted over the cover sheet and securely attached with respect thereto; and adhesive backed hook strips applied to the cover sheet so that the hooks of the hook strips engage the material of the cushioning blanket to hold the blanket in place.

2. Apparatus according to claim 1 wherein the attaching spring apparatus comprise:

First and second ends and a central spring portion, with the first ends attached to a cover sheet flange; and the second ends attached to the central shaft.

3. Apparatus according to claim 1 wherein the attaching spring apparatus comprise:

First and second ends and a central spring portion, with the first ends attached to a cover sheet flange; and the second ends attached to the mounting plate.

4. Apparatus according to claim 1 wherein the attaching spring apparatus comprise:

First and second ends and a central spring portion, with the first ends attached to the first cover sheet flange; and the second ends attached to the second cover sheet flange.

5. A rotary printing press comprising:

An impression cylinder; and

A transfer cylinder according to claim 1, with a clearance space greater than 0.38 inches there between.

6. Apparatus for a rotary printing press transfer cylinder comprising:

At least two axially spaced apart discs having a closed major segment and an open minor segment with inwardly disposed edges joining into central opening;

shaft receiving hubs mounted to the at least two discs, at the central opening and concentric with the major segments;

a flexible disc cover sheet having a length and width to cover the major segment diameters, with first and second flange portions bent to fit within the open minor segment, each flange portion including a plurality of attaching holes for attachment of the disc cover sheet to the spaced apart discs; and a plurality of attaching spring apparatus engaging the attaching holes of the first and second flange portions to pull the cover sheet against the major segment diameters.

7. Apparatus for a rotary printing press transfer cylinder according to claim 6 and further comprising an axially oriented mounting plate affixed to the at least two discs and holding tension on the attaching spring apparatus.

8. Apparatus for a rotary printing press transfer cylinder according to claim 6 and further comprising a cushioning blanket fitted over the cover sheet and securely attached with respect thereto.

9. Apparatus according to claim 8 and further comprising adhesive backed hook strips applied to the cover sheet, so that the hooks of the hook strips engage the material of the cushioning blanket to hold the blanket in place.

10. Apparatus for a rotary printing press transfer cylinder according to claim 6 and further comprising a central shaft engaging the shaft receiving hubs to support the at least two discs for rotation.

11. Apparatus according to claim 10 wherein the attaching spring apparatus comprise:

First and second ends and a central spring portion, the first ends attached to a cover sheet flange; and the second ends attached to a central shaft.

12. Apparatus according to claim 6 wherein the attaching spring apparatus further comprise:

ends configured to engage the attaching holes of the first and second flanges; and spring portions to pull the cover sheet against the outside of the spaced major segments.

13. A rotary printing press comprising:

an impression cylinder; and a transfer cylinder according to claim 6, with a clearance space greater than 0.38 inches therebetween.

14. Apparatus for a rotary printing press transfer cylinder comprising:

At least two axially spaced apart discs having a closed major segment and an open minor segment with inwardly disposed edges joining into a central opening;

shaft receiving hubs mounted to the at least two discs, at the central opening, and concentric with the major segments;

a central shaft fitted through the shaft receiving hubs;

a flexible disc cover sheet having a length and width to cover the major segment diameters, with first and second flange portions bent to fit within the open minor segment, each flange portion including a plurality of attaching holes for attachment of the disc cover sheet to the spaced apart discs;

a plurality of attaching spring apparatus engaging the attaching holes of the first and second flange portions to pull the cover sheet against the major segment diameters; and an axially oriented mounting plate affixed to the at least two discs and holding tension on the attaching spring apparatus.

15. Apparatus for a rotary printing press transfer cylinder according to claim 14 and further comprising a cushioning blanket fitted over the cover sheet and securely attached with respect thereto.

16. Apparatus according to claim 14 wherein the attaching spring apparatus further comprise:

first and second ends configured to engage the attaching holes of the first and second flanges; and central spring portions to pull the cover sheet against the outside of the spaced major segments.

17. Apparatus according to claim 16 wherein the attaching spring apparatus further comprise:

the first ends attached to a cover sheet flange; and the second ends attached to the central shaft.

18. Apparatus according to claim 16 wherein the attaching spring apparatus further comprise:

the first ends attached to a cover sheet flange; and the second ends attached to the mounting plate.

19. Apparatus according to claim 16 wherein the attaching spring apparatus further comprise:

the first ends attached to the first cover sheet flange; and the second ends attached to the second cover sheet flange.

20. Apparatus according to claim 14 and further comprising adhesive backed hook strips applied to the cover sheet so that the hooks of the hook strips engage the material of the cushioning blanket to hold the blanket in place.

21. A rotary printing press comprising:

an impression cylinder; and a transfer cylinder according to claim 16; with a clearance space greater than 0.38 inches therebetween.

* * * * *